US006316685B1

(12) United States Patent
Lauer et al.

(10) Patent No.: US 6,316,685 B1
(45) Date of Patent: Nov. 13, 2001

(54) METHOD FOR SEPARATING SOLIDS FROM HYDROCARBON SLURRIES

(75) Inventors: Robert S. Lauer, Rosenberg; Lawrence N. Kremer, The Woodlands; Joseph L. Stark, Richmond; Andrew McCallum, Katy, all of TX (US)

(73) Assignee: Baker Hughes Incorporated

( * ) Notice: Subject to any disclaimer, the term of this patent is extended or adjusted under 35 U.S.C. 154(b) by 0 days.

(21) Appl. No.: 09/727,085

(22) Filed: Nov. 30, 2000

Related U.S. Application Data

(60) Provisional application No. 60/172,338, filed on Dec. 16, 1999.

(51) Int. Cl.[7] ..... C07C 7/00; C10M 175/00; C10G 29/00

(52) U.S. Cl. ..... 585/864; 585/833; 585/865; 585/866; 208/180; 208/181; 208/298

(58) Field of Search ..... 585/864, 865, 585/866, 833; 208/180, 181, 298

(56) References Cited

U.S. PATENT DOCUMENTS

| | | | | |
|---|---|---|---|---|
| 5,476,988 | | 12/1995 | Hart et al. | 585/860 |
| 5,481,059 | | 1/1996 | Brock et al. | 585/866 |
| 5,681,457 | | 10/1997 | Mahoney | 210/198.1 |
| 5,725,780 | | 3/1998 | Carpenter et al. | 210/728 |
| 5,779,910 | | 7/1998 | Donlin | 210/726 |
| 5,804,077 | | 9/1998 | Smith et al. | 210/702 |
| 5,827,903 | | 10/1998 | White et al. | 518/710 |
| 5,843,315 | | 12/1998 | Baughn et al. | 210/723 |
| 5,882,525 | | 3/1999 | Neff et al. | 210/735 |
| 5,927,404 | | 7/1999 | Bragg | 166/275 |
| 5,945,494 | | 8/1999 | Neff et al. | 526/292.2 |
| 6,126,837 | * | 10/2000 | Miknevich et al. | 210/705 |

* cited by examiner

*Primary Examiner*—Marian C. Knode
*Assistant Examiner*—Tam M. Nguyen
(74) *Attorney, Agent, or Firm*—Madan, Mossman & Sriram, P.C.

(57) ABSTRACT

Disclosed is a method for separating finely divided solids from a hydrocarbon slurry by using an additive that comprises a polymer and, optionally, an alkylbenzene sulfonic acid; and a composition of the additive thereof. The polymer is a polymer having (a) a polymeric backbone comprising polyol units and at least one unsaturated polycarboxylic unit, (b) acrylate units coordinated via unsaturated polycarboxylic units, and (c) oxyalkylated alkyl phenol units.

8 Claims, No Drawings

METHOD FOR SEPARATING SOLIDS FROM HYDROCARBON SLURRIES

CROSS-REFERENCE TO RELATED APPLICATIONS

This application takes priority from U.S. patent application Ser. No. 60/172,338 filed Dec. 16, 1999, assigned to the assignee of this application.

BACKGROUND OF THE INVENTION

1. Field of the Invention

This invention relates to a method for separating solids from a hydrocarbon slurry. This invention particularly relates to a method for separating solids from a hydrocarbon slurry using an additive which includes a polymer.

2. Background of the Invention

Separating solids, particularly finely divided solids, from a slurry containing a fluid or liquid and such solids is needed for many different material productions either directly from natural sources or in manufacturing plants. For example, in a fluid catalytic cracking (FCC) unit, zeolitic catalysts in a fluidizable form, i.e. finely-divided particles with certain defined particle size distributions, are used to effect cracking of heavy petroleum fractions into lighter hydrocarbon products at elevated temperatures. Due to the severe reaction conditions, even the most refractory silicoaluminum oxide type molecular sieve catalysts could suffer some attrition to produce additional fine particles. Regardless the source of the finely divided particles, some of them are easily carried into the product stream. These particles need to be removed before the products can be processed further. This product stream from an FCC unit is referred to hereinafter as "slurry oil."

Another example where solids need to be separated from products is catalytic conversion of synthesis gas (syn gas), a mixture comprising primarily hydrogen and carbon monoxide, to hydrocarbons and oxygenated products. This type of reaction is commonly referred to as a Fischer-Tropsch (F-T) synthesis reaction. It is frequently carried out in a liquid slurry system with finely divided solid catalysts or in a liquid system with a homogeneous catalyst. Even with a homogeneous catalyst, it is not unusual to observe catalyst particles or other solids precipitating out of the reaction system due to decompositions or other chemical changes of the catalyst during reaction. The catalyst particles need to be separated from the solvents and reaction products as part of the purification process. If preferred, the recovered catalyst particles can be recycled for reuse, reclamation of precious metals or disposal of as waste. The solid-free product stream is then processed further.

Solids separation is also important for naturally occurring formation fluids such as crude oil, bottoms from various oil refining processes, residue and numerous streams from chemical or polymer plants. All of these streams are known to contain different types and varying amounts of finely divided solid particles. These finely divided solid particles could be inorganic materials such as sand or dirt or catalyst, organic compounds, or mixtures of organic, inorganic and organometallic compounds. The particles could exist in a wide range of sizes. These solid particles need to be separated from other products as part of the purification step. Recovery and production of minerals or metals may also require such separations of solids from an aqueous phase.

Many different methods and equipment have been used to separate, remove or recover the finely divided solids from a variety of slurry mixtures as discussed in the foregoing examples. These methods and equipment include sedimentation, magnetic separation if the particles are magnetic, and/or use of processing equipment such as hydrocyclones and centrifugal separators. In processes where direct physical/mechanical separations are not economical, technically feasible or fast enough, different chemicals have been used to effect, aid and/or accelerate settling of finely divided solid particles upon standing, storage, centrifugation or other ways. For instance, U.S. Pat. No. 5,481,059 discloses the use of an adduct between alkylphenolformaldehyde resin alkoxylate compound and polyacrylic acid to aid settling of solids. U.S. Pat. No. 5,476,988 discloses a method of accelerating settling of finely divided solids in hydrocarbon fluids by adding a certain quaternary fatty ammonium compound to the slurry.

To be effective, it is generally desirable to have chemical aids, additives and/or polymers that are large, easy to separate and/or capable of forming strong interactions with the finely divided solids present in the slurry. Such strong interactions may be chemical, physical, electrostatic, van der waals, or a combination thereof. It is also desirable to form a sludge or other forms of precipitation between the solids and the additive that are readily separable from the fluid or liquid phase of the slurry. It would be advantageous to accelerate the settling of the finely divided solids to shorten the settling time required to achieve the desired level of residual solids in the fluid/liquid phase. This would help reduce the size of the settling tank or other related equipment and/or increase the throughput of the process. It would be a further advantage if these chemical aids, additives or polymers are inexpensive or more effective than those already known.

It was unexpectedly discovered that a number of large polymers can effect settling or accelerated settling of finely divided particles when they are used as part of an additive in accordance with the present invention. The present invention is particularly useful for separating and settling finely divided solids, such as FCC catalyst, from FCC slurry oils.

SUMMARY OF THE INVENTION

The present invention relates to a method for separating solids from a hydrocarbon slurry, the method comprises adding an effective amount of an additive to the hydrocarbon slurry; mixing the additive with the hydrocarbon slurry; allowing the solids to settle and form a settled phase, wherein the additive is a polymer and, optionally, includes a sulfonic acid such as an alkylbenzene sulfonic acid. The polymer structure includes (a) a backbone comprising polyol units and at least one unsaturated polycarboxylic unit, and (b) acrylate units coordinated via unsaturated polycarboxylic units, and (c) oxyalkylated alkyl phenol units. The amount of the additive added to the hydrocarbon slurry is an effective amount, that is, it is an amount sufficient to improve solids separation in the slurry compared to a separation in the slurry over the same amount of time without the presence of the additive in such an amount.

It is another object of the present invention to have a composition of the aforementioned additive, which comprises the polymer, and, optionally, an acid, preferably a sulfonic acid such as an alkylbenzene sulfonic acid. The composition is useful for separating solids, preferably finely divided solids, from a slurry, preferably hydrocarbon slurries such as FCC slurry oils.

In another embodiment of the present invention, the additive further comprises a solvent or diluent. Suitable diluents include, but are not limited to aromatic organic solvents.

Furthermore, it is also an object of the present invention that the solids, especially finely divided solids in a slurry such as FCC slurry oils, show accelerated settling to form a sludge or a precipitation, which is readily separable from the liquid/fluid of the slurry, with the aid of an effective amount of the additive, which is added to and mixed with the slurry.

DETAILED DESCRIPTIONS OF THE INVENTION

The present invention relates to a method for separating finely divided solids from a slurry by mixing an additive with the slurry, followed by allowing the solids to settle. The additive is used in a sufficient amount to effect settling or accelerated settling of the finely divided solids. The invention also relates to a composition of an additive, which comprises a polymer or a polymer mixture, optionally in the presence of a sulfonic acid such as an alkylbenzene sulfonic acid. There may be other compounds such as solvents in the additive as well. The composition is used to effect separation, settling or accelerated settling of finely divided solids from the slurry, particularly a hydrocarbon slurry such as an FCC slurry oil. The solids in an FCC slurry oil comprise FCC catalyst particles. The present invention can also be used for an aqueous slurry.

When there are solid particles in a liquid or fluid, the particles may float to the top of, suspend in or settle to the bottom of the fluid/liquid phase. Depending on the particle sizes, the particle size distribution and other physical and chemical conditions, it is also possible that a certain combination of these possibilities may occur. It is known that the physical state of a slurry may be stable, meta-stable or even constantly changing upon standing, storage, and/or being subjected to other processing conditions such as centrifugation, agitation, hydrocyclone treatment or others.

In most commercial processes, it is necessary that the solids in a hydrocarbon slurry be separated from the fluid or liquid in order to go through other processing steps or be disposed of as waste or recycle streams. In a number of processes of producing minerals, metals, inorganic compounds and/or polymers, the solids themselves are actually the desired products. Regardless of the specific process or (by)product involved, it is usually preferable, at least for plant throughput purposes, to effect the solids separation and/or settlement as fast as possible. It is within the embodiment of the present invention to effect accelerated settling of the solids, particularly finely divided solids.

The term "finely divided" used herein means that the particles of the solid(s) present in a slurry are small enough so that they will not settle readily to the bottom or near the bottom by gravity with or without using other physical means within about one hour. There are many factors that influence the settling rate of the solids or solid particles. For instance, it is known that solids of the same or similar particle size may settle slower in a slurry with higher viscosity and/or when the fluid (liquid) phase has a higher density. It is also known that solids with higher density tend to settle faster than solids with lower density. All factors being equal, more dense particles tend to settle faster than less dense ones.

Accordingly, the range of those solids or solid particles considered to be "finely divided" in the present invention may vary somewhat depending on the composition and the properties of both the solids and the slurry. But, in general, solids having particles smaller than about 200 micrometers (microns or $\mu$) are considered to be "finely divided" for the purpose of the present invention. For the purposes of the present invention, particles as large as 1000 $\mu$ may be considered as the upper limit of being "finely divided," particularly in certain slurries with high viscosity and/or density.

The terms "hydrocarbon(s)" and "hydrocarbon fluid(s)" used herein are not limited only to those compounds or streams or products or fluids containing only carbon and hydrogen in their compositions. A number of other elements may be present in a "hydrocarbon," including, but not limited to oxygen, nitrogen, sulfur, phosphorus, silicon, and metals. Examples of hydrocarbon(s) or hydrocarbon fluid(s) include, but are not limited to, crude oil, formation fluids, resids, FCC (by)products, F-T (by)products, methanol or oxygenate conversion (by)products, various refinery bottoms, polymerization (by)products, other chemical reaction (by)products, fermentation (by)products, extraction (by)products, recycled or reclaimed (by)products from chemical reactions, waste streams from a chemical plant, combinations thereof and others. "Hydrocarbon slurry" is used herein to mean a mixture, which includes at least finely divided solids and hydrocarbon(s) or hydrocarbon fluid.

An additive suitable for separating the solids from the slurry comprises a polymer or a polymer mixture and, optionally, an alkylbenzene sulfonic acid. Optionally, the additive can further comprise a solvent or diluent such as a high aromatic naphtha. Examples of such diluents include, but are not necessarily limited to, HAN, a trade designation of Exxon and FINASOL 150, a trade designation of Petro-Fina S.A.

The polymer or polymer mixture used in the additive for separating solids from a hydrocarbon slurry oil has a general chemical structure that may be described as follows. The polymer structure includes (a) a polymeric backbone comprising polyol units and at least one unsaturated polycarboxylic unit, and (b) acrylate units coordinated via unsaturated polycarboxylic units, and (c) oxyalkylated alkyl phenol units. It should be noted that the prefix "polymeric" is used herein to include both "oligomeric" and "polymeric" as those terms understood by one skilled in the art and as further defined, where appropriate, below.

The polyol units useful with the present invention include, but are not limited to ethylene glycol, 1,2-propylene glycol, 1,3-propylene glycol, 1,2-butylene glycol, 1,4-butylene glycol, other similar linear, branched or cyclic $C_5$ to $C_{12}$ alkyl glycols and mixtures thereof. The glycols, if different, may be present randomly or in blocks. It is preferred to have polyethylene glycol segments, poly(1,2-propylene glycol) segments, poly(1,2-butylene glycol) segments, segments comprising mixed glycol units and mixtures thereof. It is more preferred the total number of monomeric ethylene oxide (EO), propylene oxide (PO) and butylene oxide (BO) equivalent units making up the polyol part of the polymer backbone is in the range of from about 50 to about 300, most preferably from about 150 to about 250.

There are additional units which are useful with the present invention, all of which are chemically attached or coordinated, directly or indirectly, to the polyol part of the polymer backbone. The additional units include, but are not limited to, acrylate units, other unsaturated polycarboxylic units and oxyalkylated alkyl phenol units and/or resins. Because all of such additional units contain one or more of alcoholic groups, carboxylate groups, phenolic groups and carbon-carbon double bonds, it is within the embodiment of the present invention that the additional units may be of different sequences or orders and can vary in the manner in which they are chemically linked to the polyol backbone and/or one another.

The acrylate units comprise one or more monomeric acrylates, preferably derived from acrylic or methacrylic units such as acrylic acid, methacrylic acid and mixtures thereof. The total number of such acrylate units in the polymer is in the range of from about 4 to about 200, preferably from about 6 to about 150.

It is within the contemplated embodiments of the present invention to use various unsaturated polycarboxylic units, including, but not limited to, maleic, fumaric, itaconic, citraconic, glutaconic, mesaconic, trans-3-hexenedioic, cis 3-hexenedioic units and mixtures thereof, to prepare the polymer. The total number of such units in the polymer is in the range of from about 1 to about 50. It is preferred that these units are coordinated or otherwise incorporated into the polymer backbone directly.

Oxyalkylated alkyl phenol units or resins may be attached to the polymer via C—C, C—O—C, C—C(=O)—O or mixtures thereof moieties. There may be one or more linear or branched alkyl substituents on the phenol rings. If there is one such substituent, it is preferred to be at the position para to the oxygen on the ring. There may also other polymeric groups, such as other polyols not directly chemically linked to the polyol backbone itself, attached to the oxyalkylated alkyl phenol units. Furthermore, the aromatic phenolic rings may be bridged (separated) by groups such as $—CH_2—$ or $—CH_2CH_2—$. The total number of phenolic units in the polymer is in the range of from about 4 to about 100, more preferably from about 6 to about 85.

It is preferred that the oxyalkylated alkyl phenol units consist essentially of poly(oxyalkyl) alkyl phenol resins. The oxyalkyl moiety comprises polyol type groups made of units of ethylene glycol (EO equivalent), 1,2-propylene glycol (PO equivalent), 1,3-propylene glycol, 1,2-butylene glycol (BO equivalent), 1,4-butylene glycol and mixtures thereof, randomly or in blocks. Block ethylene glycol units, 1,2-propylene glycol units and mixtures thereof are most preferred. The total number of such glycol units per oxyalkyl group or moiety in an ether linkage is preferably from about 5 to about 40, more preferably from about 7 to about 35.

An example of a suitable polymer to be used in the additive is ARBREAK 3084*. It is also contemplated that the polymers of the present invention can be used in mixtures with other oil soluble polymers such as BPR 44855*, BPR 49691*, and BPR 27440*. *BPR 44855, BPR 49691, BPR 27440, and ARBREAK 3084 are trade designations of Baker Petrolite, a division of Baker Hughes, Incorporated. It is also within the scope of the present invention to use two or more different polymers suitable for use with the present invention in the same additive, regardless the makeup of the rest of the additive.

All of the polymers suitable for use in the present invention, particularly for treating hydrocarbon slurries such as FCC slurry oils, may be either soluble, partially soluble or insoluble in the hydrocarbon slurry itself under the conditions of the disclosed method.

In addition to the polymer, the additive may also have a sulfonic acid selected from the group consisting of alkyl sulfonic acid, aromatic sulfonic-acid such as benzene sulfonic acid or substituted benzene sulfonic acid and mixtures thereof. Alkylbenzene sulfonic acid is a preferred sulfonic acid.

An alkylbenzene sulfonic acid suitable for use in the additive has the following general formula:

[A]

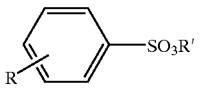

R is a substituent selected from the group consisting of H and $C_1$ to $C_{20}$ alkyls. $C_4$ to $C_{15}$ alkyls are preferred. The $C_{11}H_{23}$ isomer, i.e. para-undecanylbenzene sulfonic acid, where R is an undecanyl substituent and R' is H, is a more preferred acid.

R' is selected from the group consisting of H, Li, Na, K, Rb, Cs, $N(R_1R_2R_3R_4)^+$ and $P(R_5R_6R_7R_8)^+$ wherein $R_1$, $R_2$, $R_3$, $R_4$, $R_5$, $R_6$, $R_7$ and $R_8$, being same or different, are selected from the group consisting of H and $C_1$ to $C_{20}$ alkyls. The acid form, i.e. R' is H, is preferred.

Structure A is a general structure of a substituted alkylbenzene sulfonic acid. Para isomers are preferred. Para-undecanylbenzenesulfonic acid, para-dodecylbenzenesulfonic acid and mixtures thereof are particularly preferred for use with the present invention. It is also within the embodiment of the present invention to have some ortho- and meta-substituted isomers in addition to the para isomer in an isomer mixture. In addition, ortho or meta isomers may be used alone or as mixtures without a substantial amount of the para-substituted isomer present. There may be additional substituents on the benzene ring, such as other alkyl group(s), aryl group(s), halide(s) (F, Cl. Br), and mixtures thereof.

Two or more different aromatic sulfonic acids such as the alkylbenzene sulfonic acids disclosed herein may be used in the same additive regardless of the makeup of the rest of the additive.

Examples of alkylsulfonic acids suitable for use in the additive include, but are not limited to linear $C_1$–$C_{12}$ alkyl sulfonic acids, branched $C_1$–$C_{12}$ alkyl sulfonic acids, cyclic alkyl sulfonic acids having from five to twelve carbon atoms, amino function containing alkyl sulfonic acids having from five to twelve carbon atoms, and mixtures thereof, such as methane sulfonic acid, ethanesulfonic acid, 1- or 2-propane sulfonic acid, 1-butanesulfonic acid, 1-decanesulfonic acid, 2-aminoethane sulfonic acid, 3-aminopropane sulfonic acid, 2-(cyclohexylamino)ethane sulfonic acid, 3-cyclohexylamino-1-propane sulfonic acid, their corresponding salts similar to those salts listed above for the alkylbenzene sulfonic acid, i.e. $NH_4^+$, Na, and others, and mixtures thereof. In addition to the amino group disclosed above, there may be certain different and/or additional substituents on alkyl group, including halide(s), i.e. halogen-substituted, such as Cl, F and Br, aryl group(s) and mixtures thereof. These sulfonic acids may be obtained from, for example, Aldrich Chemical Company and other chemical companies.

Two or more different alkylsulfonic acids disclosed herein may be used in the same additive regardless the makeup of the rest of the additive. In addition, one or more alkylsulfonic acids may be used with one or more aromatic sulfonic acids in the same additive.

It is preferred to have other components in the additive in addition to a polymer and a sulfonic acid. One example of such a component is or consists essentially of a solvent, AS 220*, which is a trade designation of Nissiki Corporation and is a high aromatic naphtha. Other nonexclusive examples of such diluent or solvent include HAN and FINASOL 150.

The various components of the additive may be premixed before the additive is added to and mixed with the hydrocarbon slurry. Alternately, all or part of the components may be added separately to the slurry simultaneously or consecutively or a combination thereof. The mixing can be effected by using various mechanical mixers or any other suitable means or methods known to those skilled in the art, so long as the additive is thoroughly mixed with the slurry prior to beginning the settling process.

In the additive, the polymer or polymer mixture is present in the range of from about 3% to about 100%, preferably from about 10% to about 75%, more preferably from 40% to 60%, all by weight, of the total amount of the additive. The sulfonic add or a mixture of two or more sulfonic acids is present in the range of from about 0% to about 20%, preferably from about 0.1% to about 10%, more preferably 1% to 8%, all by weight, of the total amount of the additive. The solvent or diluent is present in the additive in the range of from 0%, i.e. no solvent or diluent, to about 75%, preferably from about 10% to about 65%, more preferably from about 25% to about 55%, all by weight, of the total amount of the additive.

The total quantity of the additive added to a slurry must be an effective amount to effect the desired settling of finely divided solids. This effective amount depends on many characteristics of the slurry such as particle surface area, number of particles and surface chemistry. Preferably, the effective amount is in the range of from about 1 ppm to about 10,000 ppm, more preferably from about 5 ppm to about 1,000 ppm, all in volume relative to the volume of the slurry to be treated. It is also within the embodiment of the present invention to use a higher amount, but it may not be preferable due to higher cost with no significant additional benefits.

The treatment temperature is the temperature at which the additive is added to the slurry. For the present invention, preferably this temperature is in the range of from about 20° C. to about 600° C., more preferably from about 50° C. to about 450° C. It is most preferred to have a treatment temperature in the range of from about 100° C. to about 200° C. when the hydrocarbon fluid is or consists essentially of a FCC slurry oil.

The settling temperature at which the finely divided solids are allowed to settle may or may not be the same as the treatment temperature. If it is different, the settling temperature can be the same, lower, or higher. A useful range of the settling temperature for the present invention is preferably from about 30° C. to about 250° C. A more preferred range for settling finely divided solids from a FCC slurry oil is in the range of from 50° C. to about 150° C., most preferably from about 60° C. to about 100° C.

The time period for carrying out the desired settling or settlement of the solids depends on a number of factors, including, but not limited to, the amount of solids present in the slurry, the required level of solids removal, the desired throughput of the unit, the effectiveness of the additive used, the settling conditions and combinations thereof. A typical range of the time period is in the range of from about ten minutes to about ten days. It is preferred to be from about one hour to about five days, more preferred from about twenty-four hours to about four days. It is sometime preferred to obtain a profile of settling by measuring the settlements of the solids at different times.

It is also an embodiment of the present invention to use the additives according to the foregoing disclosures in conjunction with other methods or apparatus or equipment known in the prior art. For instance, it may be beneficial for separating or settling finely divided solid particles from certain slurries by using the additive in accordance with the disclosed method in a centrifugal separator as one of the ways allowing the solids to separate.

As already disclosed and discussed earlier, within the embodiment of the present invention is a composition of an additive for separating solids from a hydrocarbon slurry, wherein the composition comprises a polymer and an alkylbenzene sulfonic acid represented by Structure A. Two or more polymers may be used in the same additive composition. Similarly, two or more alkylbenzene sulfonic acids may be used in the same additive composition. The composition may further comprise a solvent or diluent.

The following examples were carried out to illustrate certain embodiments of the present invention. The examples and any preferred embodiments are intended for illustration purposes only. They are not intended to limit the spirit or the scope of the invention, which is described by the entire written disclosure herein and defined by the claims below.

EXAMPLE 1

45 g of ARBREAK 3084 is combined with 5 grams of dodecylbenzenesulfonic acid, and 50 g of AS 220 in a flask at ambient conditions. The flask is shaken for 10 minutes, resulting in an additive designated herein as 99BH250. The additive obtained is used for testing its effectiveness at removing particles from hydrocarbon fluid using the procedures set forth below. Test results are reported in Tables 1 and 2.

COMPARATIVE EXAMPLE 2

Other additives are prepared substantially identically to the process of Example 1 by combining dodecylbenzenesulfonic acid and AS 220 with BPR 23625*, BPR 23555* and BPR 27400* in quantities as outlined above. *BPR 23625, BPR 23555 and BPR 27400 are trade designations of Baker Petrolite and are oil soluble polymers similar to but lacking at least one element of the polymers of the present invention. The additives obtained were then used for testing their effectiveness at removing particles from hydrocarbon fluid using the procedures set forth below. Test results are reported in Tables 1 and 2.

EXAMPLE 3

A sample of typical FCC slurry oil from an eastern Canadian refinery is used to test additives for effectiveness at increasing the rate that solids therein settle. The raw slurry oil, as received, yields a 0.366 wt % ash content, i.e. solids.

The oil samples are placed into settling bottles and subjected to mechanical mixing for about two minutes to ensure uniformity of the samples. The dosage of total additive, based on volume relative to the slurry itself, is varied from 0 (blank) to 200 ppm. The treatment temperature was about 110° C. (270° F.). The settling temperature was about 65° C. (150° F.). The settling time period was 24 hours. At the end of this period, six-milliliter (6 ml) aliquots were taken from each settling bottle at a level of 30% (volume) from the bottom of the bottles (so-called 30% method). The procedure for determining the amount of solids or residual solids in a slurry or slurry oil is set forth below. Results are reported in Table 1.

Procedure for Determining the Amount of Solids or Residual Solids in a Slurry or Slurry Oil A general procedure of determining the amount of solids or residual solids in a slurry or slurry oil is carried out as follows:

A well-mixed uniform FCC slurry oil sample containing finely divided solids is heated to about 60° C. (150° F.) so that it becomes fluid enough for complete mixing with either a two-minute mechanical mixing or a one hundred to about one hundred and fifty shakings by hand. A five milliliter (5 ml) aliquot is drawn off from the slurry sample and placed in a dry and pre-weighed crucible. After being allowed to cool to room temperature (about 23° C. to about 25° C.), the crucible containing the sample is weighed again to determine the total amount of the sample in the crucible. This sample is then placed in a muffle furnace to be ashed at a temperature of about 800° C. in air for about 16 hours (overnight). See ASTM D 482-87. The crucible along with the ash is placed in a dissector to cool to room temperature. It is re-weighed to determine the original pre-treatment/settling amount of solids in the slurry oil. If preferred, this procedure may be repeated a number of times.

A number of one hundred milliliter (100 ml) samples of the uniform well-mixed FCC slurry oil are poured into separate settling bottles. These samples are heated to the desired treatment temperature. After reaching the treatment temperature, the additive, in predetermined amounts, is added to the settling bottles. For each set of experiments, at least one sample should be used as a blank control without the additive.

These samples in the settling bottles are then brought to the desired settling temperature by heating in an oven, oil bath or water bath, depending on which would be most convenient for a particular settling temperature. As stated before, the treatment temperature and the settling temperature may be the same or different. Once the settling temperature is reached, the sample is then mechanically mixed for about two minutes or mixed by shaking thoroughly (about 100 to 150 shakings). The samples are then allowed to stand for a pre-determined time period for settling without disturbance. When trying to obtain a time-related profile of solid settlements, aliquots are withdrawn at different time periods.

At the time of withdrawals, a six to ten milliliter (6–10 ml) aliquot is taken and placed in a pre-weighed crucible to be ashed and the solid content measured as described above. For the final withdrawal, the top fifty milliliters of the slurry are removed carefully without upsetting the solids settled at the bottom of the settling bottles.

The solid content is calculated according to the following equation:

$$\frac{Weight_{crucible\ and\ ash} - Weight_{crucible}}{Weight_{crucible\ and\ slurry\ oil} - Weight_{crucible}} \times 100$$

It is sometimes preferable to run more than one sample for each particular additive or condition to determine the reproducibility, accuracy as well as precision of the experiments.

TABLE 1

| Additive | Additive Dosage, ppm by volume | Weight % of Solids |
|---|---|---|
| None | None | 0.131 |
| 99BH250 | 100 | 0.079 |
| 99BH250 | 200 | 0.068 |
| BPR 44855* | 50 | 0.216 |
| BPR 44855* | 100 | 0.220 |
| BPR 44855* | 150 | 0.221 |
| BPR 44855* | 200 | 0.240 |

TABLE 1-continued

| Additive | Additive Dosage, ppm by volume | Weight % of Solids |
|---|---|---|
| BPR 49691* | 50 | 0.244 |
| BPR 49691* | 100 | 0.238 |
| BPR 49691* | 150 | 0.249 |
| BPR 27440* | 200 | 0.148 |

*Not an example of the present invention.

EXAMPLE 4

A sample of slurry oil from a Great Lakes Region refinery is tested substantially identically to the oil slurry in Example 3 except that the raw slurry oil yields a 0.345 wt % solids content upon ashing, the treatment temperature was about 93° C. (200° F.), the settling temperature was about 82° C. (180° F.), and the settling time period was set at either 24 or 36 hours. The results of this time-profile of solids settling with different dosages are shown below in TABLE 2.

TABLE 2

| Additive | Additive Dosage, ppm by Volume | Time (hr) | Weight % of Solids |
|---|---|---|---|
| Blank | 0 | 24 | 0.127 |
| 99BH250 | 100 | 36 | 0.050 |
| BPR 44855* | 100 | 24 | 0.120 |
| BPR 44855* | 150 | 24 | 0.118 |
| BPR 44855* | 250 | 24 | 0.108 |
| BPR 44855* | 200 | 36 | 0.103 |
| BPR 49691* | 100 | 24 | 0.121 |
| BPR 49691* | 150 | 24 | 0.122 |
| BPR 49691* | 250 | 24 | 0.108 |
| BPR 49691* | 200 | 36 | 0.104 |
| BPR 27440* | 50 | 36 | 0.095 |
| BPR 27440* | 100 | 24 | 0.122 |
| BPR 27440* | 150 | 24 | 0.118 |
| BPR 27440* | 250 | 24 | 0.118 |
| BPR 27440* | 200 | 36 | 0.089 |

*Not an example of the present invention.

What is claimed is:

1. A method for separating solids from a hydrocarbon slurry comprising:

mixing an effective amount of an additive with a hydrocarbon slurry; and allowing solids from the slurry to settle and form a settled phase, wherein the additive is a polymer having (a) a polymeric backbone comprising polyol units and at least one unsaturated polycarboxylic unit, (b) acrylate units coordinated via unsaturated polycarboxylic units, and (c) oxyalkylated alkyl phenol units.

2. The method of claim 1, wherein the additive also includes a sulfonic acid selected from the group consisting of aromatic sulfonic acids, alkyl sulfonic acids and mixtures thereof.

3. The method of claim 2, wherein the aromatic sulfonic acid has a general formula:

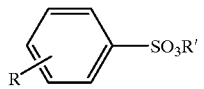

wherein R is a substituent selected from the group consisting of H and $C_1$ to $C_{20}$ alkyls; and R' is selected from the group consisting of H, Li, Na, K, Rb, Cs, $N(R_1R_2R_3R_4)^+$ and $P(R_5R_6R_7R_8)^+$, wherein $R_1$, $R_2$, $R_3$, $R_4$, $R_5$, $R_6$, $R_7$, and $R_8$ are independently selected from the group consisting of H and $C_1$ to $C_{20}$ alkyls and at least one of $R_5$, $R_6$, $R_7$ and $R_8$ is not H; and wherein the alkyl sulfonic acid is selected from the group consisting of linear $C_1$–$C_2$ alkyl sulfonic acids, branched $C_1$–$C_{12}$ alkyl sulfonic acids, cyclic alkyl sulfonic acids having five to twelve carbon atoms, amino function containing alkyl sulfonic acids having five to twelve carbon atoms, and mixtures thereof.

4. The method of claim 1, wherein the effective amount of the additive is in the range of from about 5 ppm to about 1000 ppm, by volume, of the hydrocarbon slurry.

5. The method of claim 2, wherein the additive also includes a diluent or a solvent.

6. The method of claim 2, wherein the aromatic sulfonic acid is selected from the group consisting of para-undecanylbenzenesulfonic acid, para-dodecylbenzenesulfonic acid and mixtures thereof.

7. The method of claim 3, wherein the polymer is in the range of from about 3% to about 100%, by weight, of the additive; and the aromatic sulfonic acid, 1% to 8%, by weight, of the additive, is para-substituted and the substituent is selected from the group consisting of $C_4$ to $C_{15}$ alkyls.

8. The method of claim 1, wherein the polyol units are selected from the group consisting of polyethylene glycol segments, polypropylene glycol segments and mixtures thereof; and the oxyalkylated alkyl phenol units consist essentially of oxyalkylated alkyl phenol resins.

* * * * *